US007292701B2

(12) United States Patent
Nørgaard et al.

(10) Patent No.: US 7,292,701 B2
(45) Date of Patent: Nov. 6, 2007

(54) FILTER MANIPULATOR, FILTER, HOLDER FOR A NUMBER OF FILTER MANIPULATORS, AND SYSTEM COMPRISING A FILTER MANIPULATOR AND A HOLDER FOR A FILTER MANIPULATOR

(75) Inventors: Jesper Bach Nørgaard, Hellerup (DK); Klaus L. Svendsen, Hellerup (DK)

(73) Assignee: Oticon A/S, Smørum (DK)

( * ) Notice: Subject to any disclaimer, the term of this patent is extended or adjusted under 35 U.S.C. 154(b) by 227 days.

(21) Appl. No.: 10/502,096

(22) PCT Filed: Jan. 31, 2003

(86) PCT No.: PCT/DK03/00063

§ 371 (c)(1),
(2), (4) Date: Jul. 22, 2004

(87) PCT Pub. No.: WO03/067926

PCT Pub. Date: Aug. 14, 2003

(65) Prior Publication Data

US 2005/0074136 A1 Apr. 7, 2005

(30) Foreign Application Priority Data

Feb. 7, 2002 (DK) ..... 2002 00185

(51) Int. Cl.
*H04R 25/00* (2006.01)

(52) U.S. Cl. ..... 381/329; 381/325

(58) Field of Classification Search ..... 381/328–329, 381/322, 312, 380, 325, 324; 600/25; 607/56, 607/57; 181/129–130, 135
See application file for complete search history.

(56) References Cited

U.S. PATENT DOCUMENTS

| | | | | |
|---|---|---|---|---|
| 4,840,249 | A | 6/1989 | Birkholz et al. | 181/129 |
| 4,870,689 | A * | 9/1989 | Weiss | 381/325 |
| 4,972,488 | A | 11/1990 | Weiss et al. | 381/68.1 |
| 4,984,277 | A * | 1/1991 | Bisgaard et al. | 381/325 |
| 5,131,128 | A | 7/1992 | Bisgaard | 29/239 |
| 5,199,565 | A * | 4/1993 | Voroba | 206/704 |

(Continued)

FOREIGN PATENT DOCUMENTS

| | | |
|---|---|---|
| EP | 0312517 | 4/1989 |

(Continued)

*Primary Examiner*—Huyen Le
(74) *Attorney, Agent, or Firm*—Dykema Gossett PLLC

(57) ABSTRACT

A wax filter manipulator, wax filter, holder for a number of wax filter manipulators, and system comprising a wax filter manipulator and a holder for a wax filter manipulator, the system comprising a wax filter manipulator and a holder for a wax filter manipulator, whereby the manipulator has a first tool part for initially holding and subsequently releasing a new wax filter in the sound outlet tube or vent opening of a hearing aid and a second tool part adapted to receive and hold a used wax filter, where the manipulator further comprises a gripping part to be gripped and held by a person and where the first and second tool parts are arranged side by side and extend essentially in the same direction from an edge portion of the gripping part, whereby the holder for the manipulator comprises at least one pocket for accommodating at least that edge part of a manipulator, which holds the two tool parts.

17 Claims, 7 Drawing Sheets

U.S. PATENT DOCUMENTS

| | | | | |
|---|---|---|---|---|
| 5,278,360 | A * | 1/1994 | Carbe et al. | 181/135 |
| 5,293,008 | A * | 3/1994 | Danielsen | 181/135 |
| 5,401,920 | A | 3/1995 | Oliveira | 181/135 |
| 5,982,908 | A * | 11/1999 | Bauman | 381/325 |
| 6,006,857 | A | 12/1999 | Leight et al. | 181/135 |
| 6,079,296 | A * | 6/2000 | Muromoto | 81/9.43 |
| 6,205,227 | B1 * | 3/2001 | Mahoney et al. | 381/328 |
| 6,310,961 | B1 * | 10/2001 | Oliveira et al. | 381/328 |
| 6,682,534 | B2 * | 1/2004 | Patel et al. | 606/79 |
| 6,795,562 | B1 * | 9/2004 | Gunnersen et al. | 381/325 |
| 2002/0027996 | A1 * | 3/2002 | Leedom et al. | 381/322 |

FOREIGN PATENT DOCUMENTS

| | | |
|---|---|---|
| EP | 0724377 | 7/1996 |
| WO | 0003561 | 1/2000 |

* cited by examiner

FILTER MANIPULATOR, FILTER, HOLDER FOR A NUMBER OF FILTER MANIPULATORS, AND SYSTEM COMPRISING A FILTER MANIPULATOR AND A HOLDER FOR A FILTER MANIPULATOR

AREA OF THE INVENTION

The invention concerns a filter manipulator and a filter. Filters are used in hearing aids to avoid clogging of the sound outlet opening or vent and as acoustic filters in the sound path from the receiver to the ear. Hearing aids of the in the channel type has a housing placed within the ear canal of the hearing aid user, and has a sound outlet opening facing the inner ear and connected with a telephone or receiver unit. It is a well-known problem that the sound outlet opening is prone to clogging with cerumen or ear wax which is naturally produced in the ear canal. Such clogging will reduce the output sound pressure from the hearing aid and the sound outlet opening must be protected against this. Also, in behind the ear style hearing aids the sound outlet of the ear plug may be protected from being clogged with ear wax by a wax filter.

BACKGROUND OF THE INVENTION

A prior art wax filter manipulator and wax filter is known from PCT publication No. WO 0003561 by Tøpholm & Westermann. The wax filter according to this document comprises an essentially tubular element adapted to the mouth diameter of the acoustic outlet passage or the vent and has a through-going cavity, which in one end is partially closed by an ear wax retaining guard. The element in the opposite end is connected to a surrounding abutment collar for sealing abutment against the hearing aid housing around the acoustic outlet port or vent. The element is made of an elastically yielding material and the through-going cavity at its mouth in the abutment collar is adapted for introduction of a means to be used when the ear wax guard is inserted in and removed from the acoustic outlet port or the vent. Typically silicone rubber or a thermoplastic elastomer is used for this known ear wax filter.

From the above document a manipulator for insertion and extraction of the described wax filter is known. The manipulator according to the document comprises an essentially rod-shaped applicator. In the one end the rod is provided with a smooth pin fitting the mouth of the through-going cavity of the wax filter for use at the insertion of the ear wax filter. In the opposite end the rod-shaped manipulator is provided with a catch member for use at removal of the wax filter and engaging the wall inner side of the through-going cavity when pressed into it. The catch member has a harpoon-shaped pressing-in peak projecting from the end surface thereof and further has catch edges for providing an engagement with the mouth of the through-going cavity in the wax filter.

The soft material of the prior art wax filter and the harpoon-shape of the pressing-in peak has the drawback that the user cannot determine when the pressing-in peak has reached a sufficient depth to draw out an old wax filter. The user is at risk of exerting a force which is too high, and thereby forcing the used filter further into the hearing aid. This may damage the hearing aid and also it is difficult to extract the filter from within the hearing aid. It is further a problem with the soft material that new filters some times fall out of the sound outlet orifice. Also, the process of extracting an old filter and inserting a new one demands that the user turn the rod shaped manipulator around in order to bring the new filter, which is positioned at the other end of the rod shaped applicator in position for insertion. This action is easily performed by most people, but as many hearing aid users are elderly, this operation could prove cumbersome and the applicator may be dropped or fall out of the hand during the turn around motion. Should the rod shaped applicator be dropped it might, due to its round shape roll along the floor and end under furniture or other objects, wherefrom it is only retrieved with difficulty.

Also a system comprising a number of applicators and filters of the above-described kind in a holder is known and sold by Widex®. The holder comprise a single array of holes wherein each hole accommodates one of the rod shaped applicators, such that a first end of the applicator is inserted into the hole and the other end is sticking out in order to be gripped by the user. It requires good eyesight and good dexterity to extract one single manipulator from the array of manipulators, as these are placed with parallel length axes adjacent each other in the array of holes. Not all hearing aid users have these skills. Further, if the user should inadvertently re-insert one of the applicators after use, there is nothing to prevent this insertion, and the user might at a later time erroneously try to insert the old wax filter from this used re-inserted applicator in his hearing aid.

It is the object of the invention to provide a filter, a filter manipulator and system comprising a number of applicators in a holder, which does not have the above draw backs. Such a filter, filter manipulator and system would be usable both for handling wax filter and for handling acoustic filters or microphone inlet filters.

SUMMARY OF INVENTION

In a first aspect the invention comprises a filter manipulator for extraction of a used wax filter and for insertion of a new filter in a hearing aid. The manipulator comprises a gripping part to be gripped and held by a user and has a first tool part extending from the gripping part for initially holding a new wax filter and subsequently releasing the filter in the sound outlet tube, vent opening or sound canal. According to the invention a second tool part is arranged adjacent to the first tool part and is adapted to receive and hold a used wax filter in order to extract the filter from the sound outlet, vent opening or from a sound canal of a hearing aid.

Because the second tool part is arranged adjacent to the first tool part, the user is not obliged to turn the manipulator around, when an old filter is extracted, and a new filter is to be inserted. The same grip can be maintained during the whole procedure of extracting the old filter and inserting the new filter. This greatly facilitates the exchange of filters in hearing aids, especially for people with reductions in eyesight and dexterity.

The gripping part can be made in any desired shape, as long as it can easily be gripped and held by one hand of the user. Preferably the gripping part is made as a flat elongate object, which is sized to be easily pinched between two fingers, preferably thumb and index finger of a user. The two tool parts extend from one and the same edge portion of the gripping part.

In a preferred embodiment of the invention the second tool part comprise a protruding part extending from the edge portion of the gripping part, whereby the protruding part at its outer end has an outwardly extending flange portion. The protruding part has a stub-like appearance and it has an outer diameter, which allows it to enter into the open end of a filter whereby the outwardly extending flange portion is intended to engage behind an inwardly extending flange in the filter.

Preferably that surface of the outwardly extending flange portion which faces the edge portion of the gripping part extends essentially perpendicular to the length axis of the protruding part. This is important to ensure both good hold of the inwardly extending flange of the filter and also in order that a clear click is produced once the flange portion of the tool and the flange portion of the filter pass each other during insertion of the tool. The click sound helps the user to know when the tool is inserted to the depth required for extraction of a used filter and this is particularly important when the filter is a wax filter. The click is not only audible, but will also be felt as a mechanical impulse at the fingertip of the user, and hearing aid users with deep hearing losses will benefit from this.

In an embodiment the protruding part is sectioned in the direction of the length axis thereof into two or more independent sections with slots of free space between the sections. The individual sections will have better flexibility in the transverse direction, and this facilitates the insertion of the protruding part into the filter. Also in the free space between the sections ear wax or other deposits from the filter may accumulate during insertion of the tool in the filter, and this may help prevent deposits from getting squeezed out of the retaining wall of a wax filter or out of a filter segment of an acoustic filter.

In a different embodiment of the second tool, this comprises blade parts having first and second opposed blade parts for gripping and holding a filter at the external circumference thereof. The blade parts are inserted under the outwardly extending flange portion of the filter and grips around the circumference of the filter. Once the tool is brought in this position the filter is simply pulled out.

Preferably the blade parts are arranged to extend along the surface of the edge portion of the gripping part but distanced from said edge portion. In this way the outwardly extending flange part of the filter gets lodged in between the blade parts and the edge part during capture of the used filter, and the filter will stay with the manipulator after extraction. Also by slightly varying the distance between the blade parts the tubular element of the filter may be sized between the blades and an audible click could be produced. This measure further ensures that the used filter cannot readily be pulled off or dropped from the manipulator. As described above the blade parts capture the filter by sliding the tool along the surface of the hearing aid in motion perpendicular to the length axes of the filter. A motion in the direction of the length axis of the filter may be preferred, and to this end the blades may be arranged in slightly resilient relationship with the edge portion. When the tool is pressed towards the filter in the direction of the length axis thereof, the blade portions bend away from each other in a first motion. A second motion follows when the pressure is release, and the blade portions returns to grip under the outwardly extending flange of the filter. Hereafter the filter may be extracted by pulling the tool away from the hearing aid.

In a further aspect the invention comprises a filter. The filter comprises an essentially tubular element adapted to the mouth diameter of the acoustic outlet passage, the vent or the sound canal, where the tubular element at a first opening has an ear wax retaining barrier, or a filter segment whereby the element is made of a rigid material and the tubular element at its second opening has an outwardly extending flange portion and/or an inwardly extending flange for removal of the filter from the acoustic outlet port or the vent. Depending on the embodiment chosen for the tool, either the outwardly or the inwardly extending flange portion is used for the extraction of the filter. The hardness of the material helps to generate the audible sound, which tells the user that the used filter is fixed on the extraction tool.

In an embodiment of the filter, the inwardly-extending gripping-flange at the second opening has a surface facing away from the opening of the filter whereby the surface extends perpendicular to the length axis of the through-going canal. This helps both to produce the audible sound when inserting the tool in the filter for the extraction and to obtain secure engagement with the surface facing away from the opening.

Preferably the innermost diameter of the gripping flange is smaller than the diameter of the outwardly extending flange on the corresponding extraction tool.

In a further aspect the invention comprises a holder for a number of filter manipulators and has a number of pockets, each shaped to accommodate one manipulator such that the gripping part of the manipulator is accessible for gripping by the fingers of a user and such that an edge part of each manipulator with two tools extending therefrom is accommodated within the pocket. By accommodating both tools of a manipulator within the pockets, it is assured that the tools do not become contaminated and are completely clean when the manipulator is to be used.

Preferably each pocket has engagement means for releasable engagement with a filter manipulator. Thereby the manipulators stay with the holder also if the holder should be overturned. Preferably a click mechanism is used, but any frictional engagement can be used.

In a preferred embodiment the holder has a center part with the pockets arranged to extend radially away from said center part. This aids to keep a distance between the gripping parts sticking out of the holder, such that each manipulator may readily be gripped without interfering with further manipulators in the holder.

The pockets are preferably arranged flat in one and the same plane. This provides a simple flat holder, wherein the pockets are extending in the horizontal direction, and this also helps to keep dirt out of the pockets.

In a further aspect the invention also comprises a system having a filter manipulator and a holder for a filter manipulator. The manipulator has a first tool part for initially holding and subsequently releasing a new filter in the sound outlet tube, vent opening or sound canal of a hearing aid and a second tool part adapted to receive and hold a used filter, where the manipulator further comprises a gripping part to be gripped and held by a person. According to this aspect of the invention the first and second tool parts are arranged side by side at the flat gripping part, whereby the holder for the manipulator comprises at least one pocket for accommodating at least the two tool parts. The two tool parts may advantageously extent from one and the same edge portion, and the pockets should then be arranged to accommodate this edge portion and the two tool parts.

Preferably a snap lock mechanism is provided between the holder and the filter manipulator for releasable engagement between the two. In this way the manipulators are releasable stored in the holder, until a user pulls one out.

In a preferred embodiment of the system, the locking mechanism comprises a U-shaped cut-out in the manipulator with a first and a second leg, and a protruding part inside the pocket, whereby the legs of the U-shaped cut-out of the manipulator are shaped to embrace the protruding part in interlocking engagement when the manipulator is inserted into the pocket.

Preferably the U-shaped part is arranged between the two tool parts of the manipulator, and such that the first and second leg of the U-shaped part carry the first and second tool part respectively.

Further it is preferred that the filter manipulator and the pocket are shaped in asymmetric fashion, such that the manipulator can only be inserted in the pocket when oriented in one way with respect to the holder. This helps to ensure that the user does not inadvertently re-insert a used manipulator with a used filter positioned on the second tool.

Further it is preferred that the pocket has material parts or shoulders, which narrowly surrounds the second tool part of the manipulator when the manipulator is placed in the pocket in order that the manipulator cannot be inserted into the pocket of the holder once a used filter is held at the second tool part. Hereby it becomes impossible to re-insert the manipulator also when it is not turned over, but in the correct insertion position, once a used filter is in place at the second tool.

It is preferred that the U-shaped part is slightly off-set to one side to make one of the legs of the U-shaped part bigger than the other leg, and that the corresponding protruding part in the pocket is similarly off set to thereby assure the asymmetric shape of the manipulator and pocket. This is a simple and straightforward way of providing the asymmetric shape of the manipulator.

DESCRIPTION OF A PREFERRED EMBODIMENT

Figure 1:
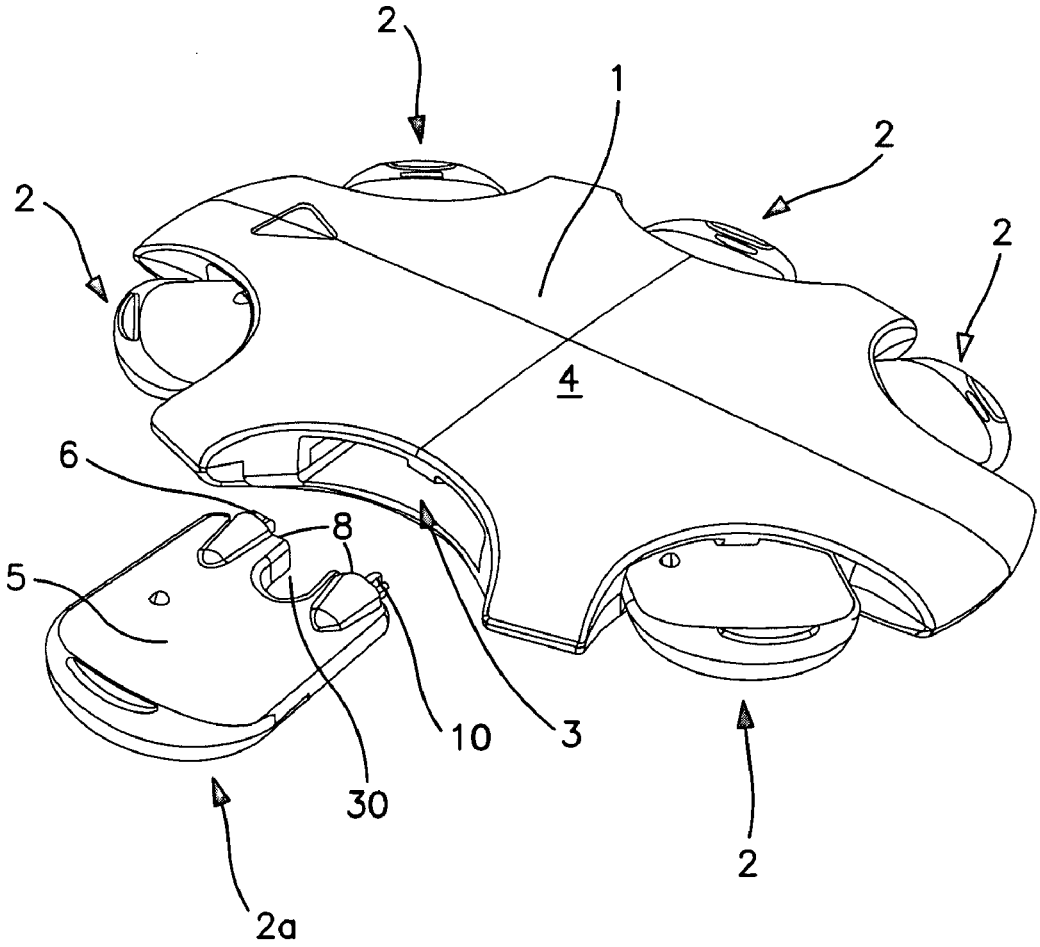
FIG. 1 is a perspective view of the system according to the invention with the holder and manipulators inserted therein.

FIG. 1 shows the system according to an embodiment of the invention. The holder 1 is flat and has pockets 3 placed in a plane around the circumference of a center part 4, and the manipulators 2 are placed in the pockets 3. The manipulator 2*a* is shown outside a pocket 3. Each manipulator 2, 2*a* has a flat gripping part 5 and as can be seen in the figure this gripping part 5 is readily accessible even when the manipulator 2, 2*a* is placed in the pocket 3. This is due to the arrangement of the pockets 3 extending radially away from the center part 4 of the holder 1. In this way each of the manipulators 2 can be gripped and extracted from a pocket 3 without disturbing neighbouring manipulators 2 and neither good dexterity nor good eyesight is demanded. Further the openings of the pockets 3 will be oriented in the horizontal direction during normal use of the holder, and they are therefore not likely to be contaminated with dirt.

Once extracted from the holder 1, an edge portion 8 of the manipulator 2 having the two tools 6, 7 (see FIG. 2) becomes visible. The first tool 6 is intended to hold a new wax filter 10. This tool is basically a protruding part, which fits into the canal 11 (see FIGS. 2-4) of the wax filter 10 with a predetermined friction fit. This fit is chosen so as to ensure that the wax filter 10 does not fall off the tool 6 when handled by the user, and on the other hand the fit must be so light that the wax filter 10, when inserted into the output canal or the vent, will stay with the hearing aid and not with the tool 6 once the tool 6 is removed.

The second tool 7 is also basically a protruding part 13, and it is placed along the same edge portion 8 as the first tool part 6, and comprises an outwardly oriented flange portion 12 arranged on the outer end of a protruding part 13, which extends from the edge portion 8.

The wax filter 10 (shown in FIGS. 3 and 4) has a through going canal 11, which in the one end has a wax retaining barrier 21 and in the other end has an inwardly directed flange portion 22. The filter 10 is inserted in the output canal or the vent with the wax retaining barrier 21 seated inside the hearing aid. At the other end the filter 10 further has an outwardly directed flange portion 23, which ensures that the filter 10 does not get inserted to deep into the hearing aid.

When the filter is to be taken out of the output canal or vent, the protruding part 13 of the second tool 7 is inserted into the canal 11 of the filter, and gently pressed towards the hearing aid until the outwardly oriented flange portion 12 of the protruding part 13 has passed past the inwardly oriented flange portion 22 of the filter. Because the flange portion 12 of the protruding part 13 has a slightly larger diameter than the inwardly directed flange portion 22 of the wax filter 10, a small click will be heard when the correct insertion depth of the tool 7 into the canal is reached. This may also be felt as a small vibration in the gripping part 5 of the manipulator 2. The click tells the user, that the tool 7 now is inserted sufficiently deep, and that the filter 10 can be extracted. The extraction simply takes place by pulling the manipulator away from the hearing aid after insertion, and the wax filter 10 now safely locked with the tool 7 will be pulled out of the hearing aid. The engaging parts of the flanges 12, 22 are oriented perpendicular to the canal axis during the pulling out motion. In order for the click to be heard, the material of the filter must have a certain rigidity.

The protruding part of the second tool 7 is preferably hollow and/or sectioned into two or more independent sections along the length axis thereof. In the embodiment according to the figs. the sections extend radially from a center point. This helps to make the protruding part flexible, so that it will enter the canal easily and pass the inwardly directed flange 22 of the filter 10. Also wax from within the filter may accumulate in the space between the sections and/or inside the hollow of the protruding part during insertion of the tool.

Figure 5:
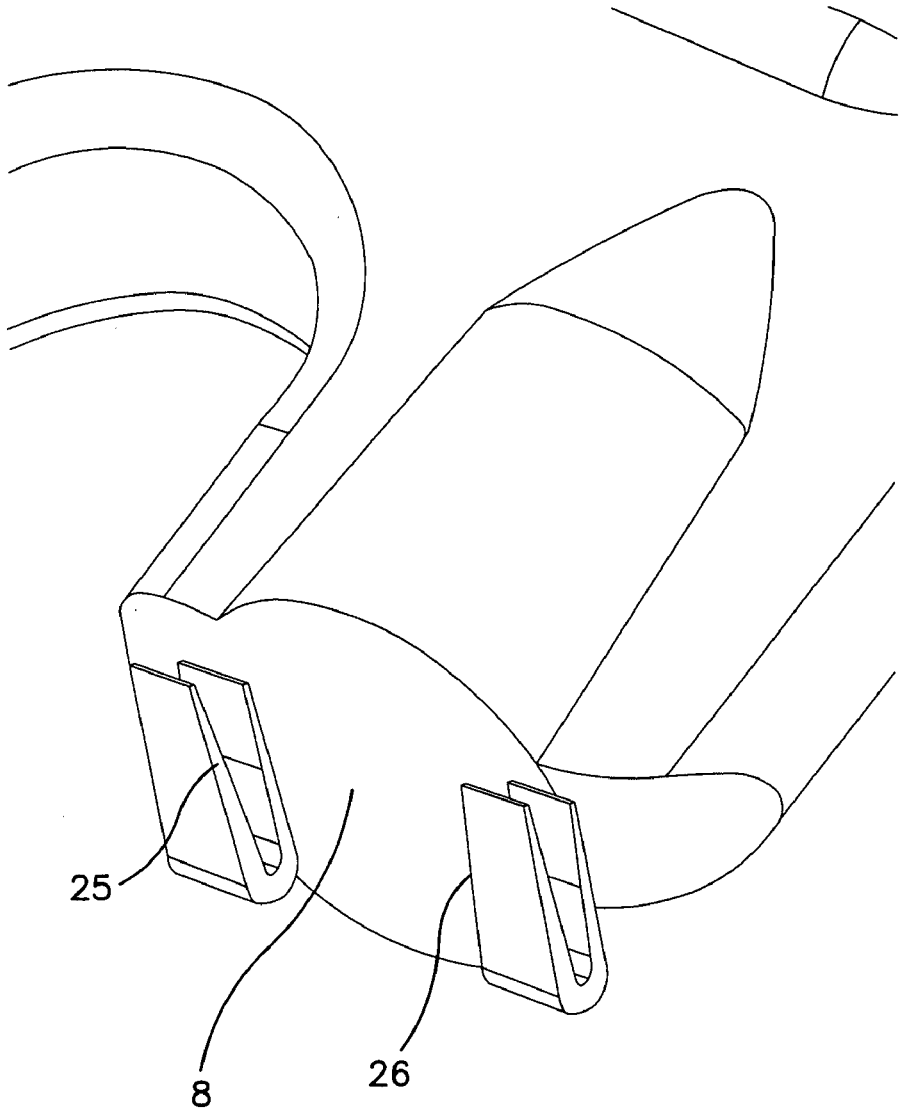
FIG. 5 is a perspective view of an extractor tool in further embodiment and FIG. 6 is a perspective view of the tool in FIG. 5, but with a wax filter held thereon.
Figure 6:
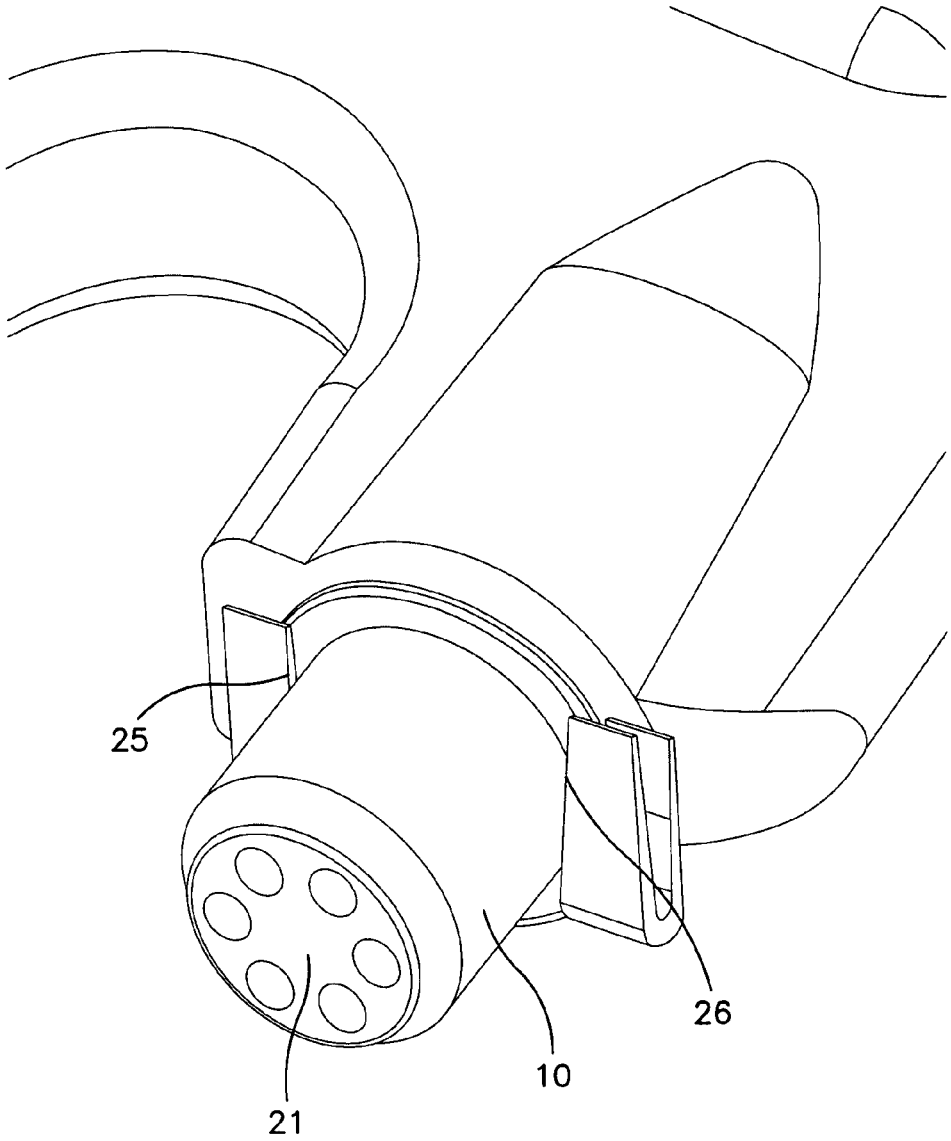

In FIG. 5 and FIG. 6 a further embodiment of the second tool 7 is displayed. The tool 7 according to this embodiment comprises tow opposed blade parts 25, 26 extending along the surface of the edge 8 of the manipulator. The blade parts 25, 26 are arranged at some distance from the surface of the edge 8, such that the outwardly extending flange part 23 of the wax filter 10 may pass between the blade parts 25, 26 and the surface of the edge 8. The distance between the blade parts 25,26 is chosen so as to allow the external circumference of the wax filter 10 beneath the flange part 23 to pass between the first blade part 25 and the second blade part 26 as can be seen in FIG. 6. The distance between the first 25 and second blade part 26 may be varied, such that when the manipulator is handled to slide the blades in under the flange 23, there will bee an audible click. Varying the distance between the blades in keyhole fashion could do this.

Figure 2:
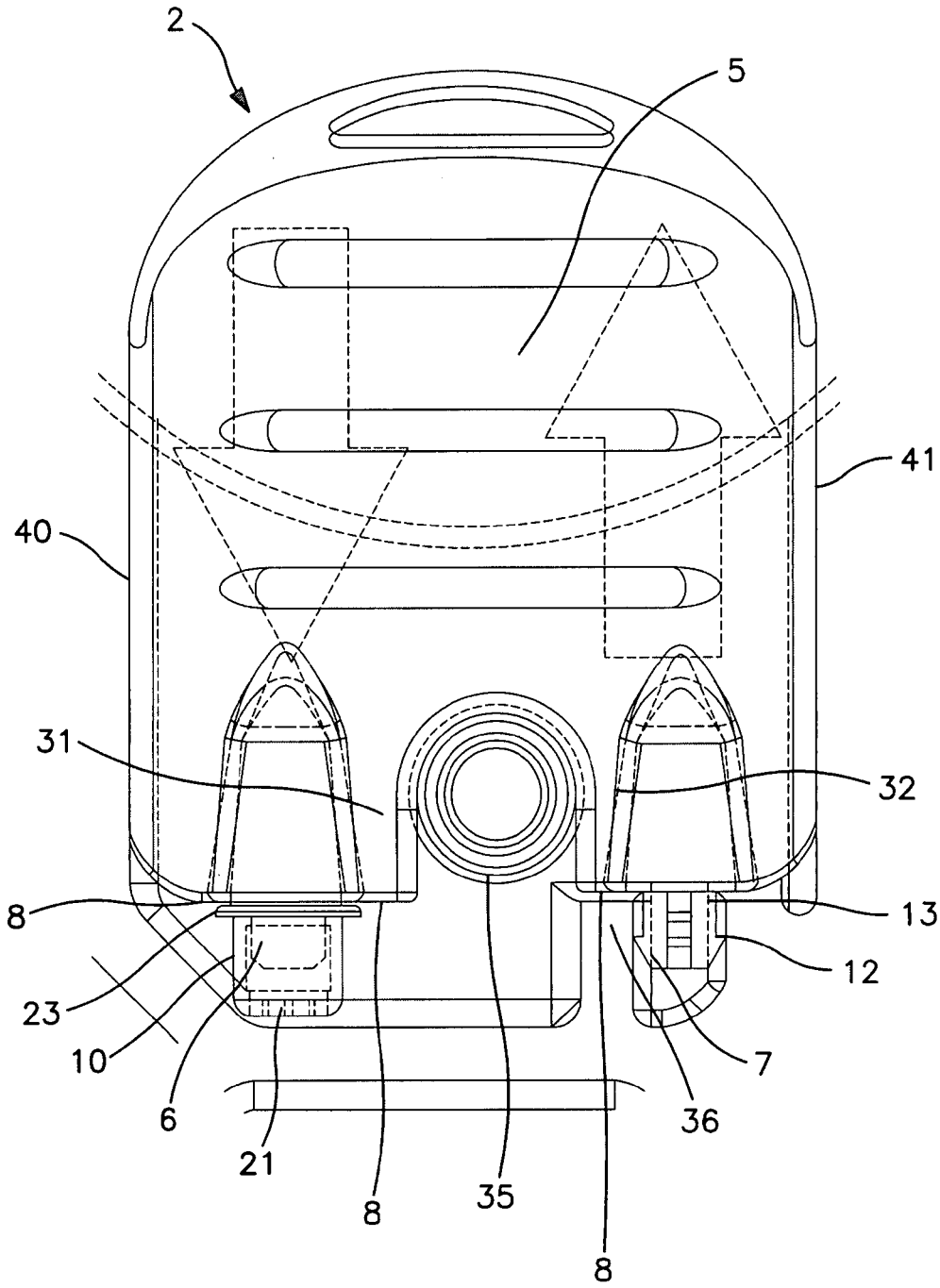
FIG. 2 is a plane view of the manipulator in the holder without a top part of the holder.
Figure 3:
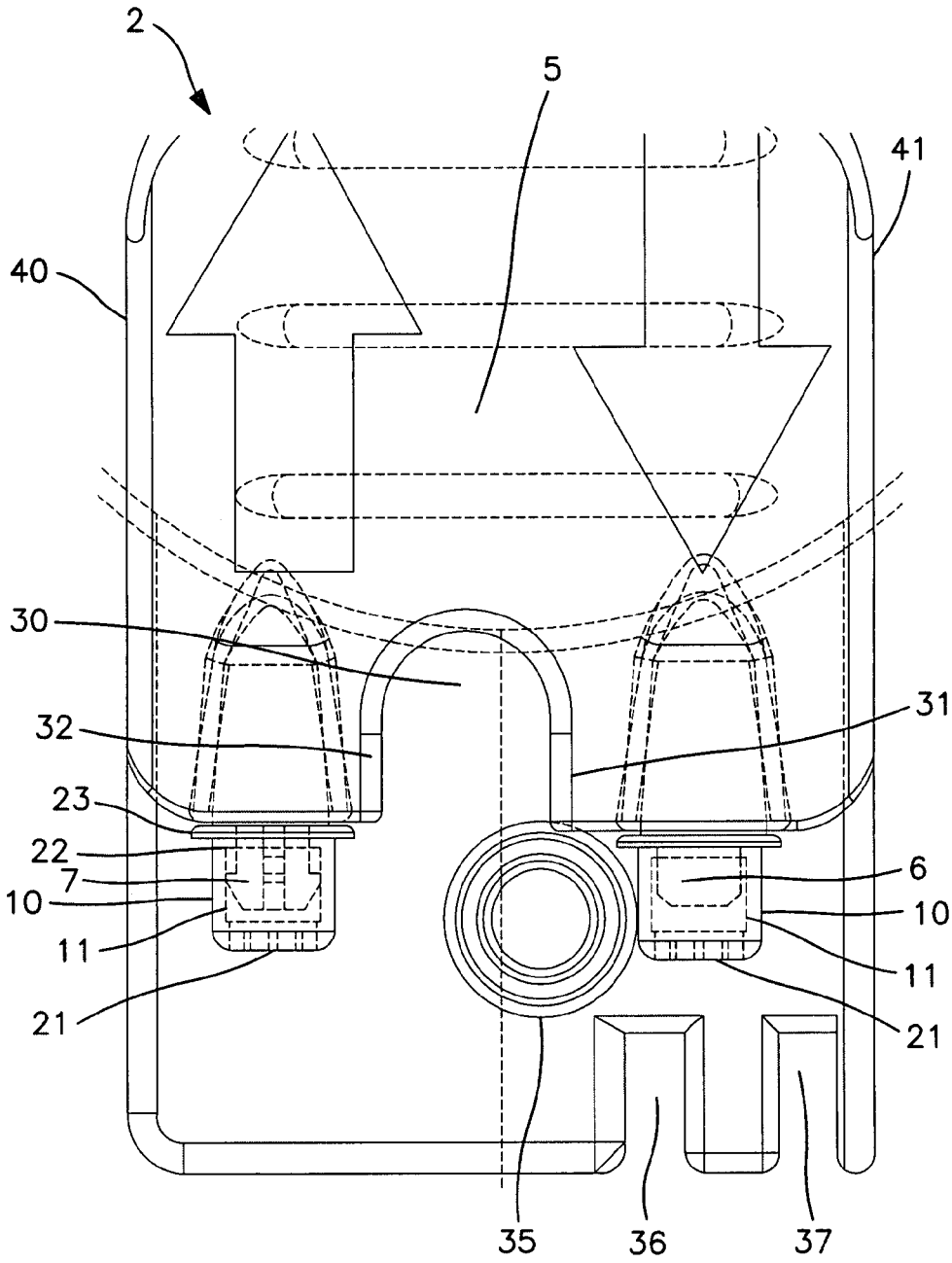
FIG. 3 is a plane view as in FIG. 2, but showing the manipulator when inserted in the turned over position.

In FIG. 1-3 it can be seen how the edge portion 8 is shaped with a U-shaped cut out 30. The U-shaped cut out has two leg parts 31, 32. The distance between the first leg part 31 and the second leg part 32 varies slightly. When the manipulator is inserted in the pocket 3, the leg parts 31, 32 embraces a protrusion 35 within the pocket 3, and the varying distance between the leg parts 31,32 causes a snap lock effect. As can be seen from FIG. 2 the protrusion 35 has a transverse dimension, which is slightly bigger than the distance between the first 31 and second leg portion 32. In FIG. 2 the manipulator is shown inserted in the pocket 3 and the leg parts 31, 32 are embracing the protrusion 35, and thereby the manipulator is releasable held in the pocket 3. A snap lock mechanism of this kind can be made in many other ways. Bumps on the surface of the manipulator, which interact with indents on the inside surface of the pocket or visa versa could be used to produce such a snap lock effect.

The edge part 8 of the manipulator extends to both sides of the cut out 30, but as the cut out 30 is not placed symmetrically between side edges 40, 41 of the manipulator the two edge parts extending at each their side of the cut out 30 have different lengths. Through this the manipulator 2 cannot be inserted and held in the pocket 3 if the manipulator 2 is turned upside down. In FIG. 3 it is shown how the cut out 30 is misaligned with respect to the protrusion 35 if insertion in turned over position is attempted. Many other ways of achieving this effect are possible. Any non-symmetric shaping of the manipulator and pocket with respect to a plane through the center axis thereof is likely to produce this effect.

Figure 4:
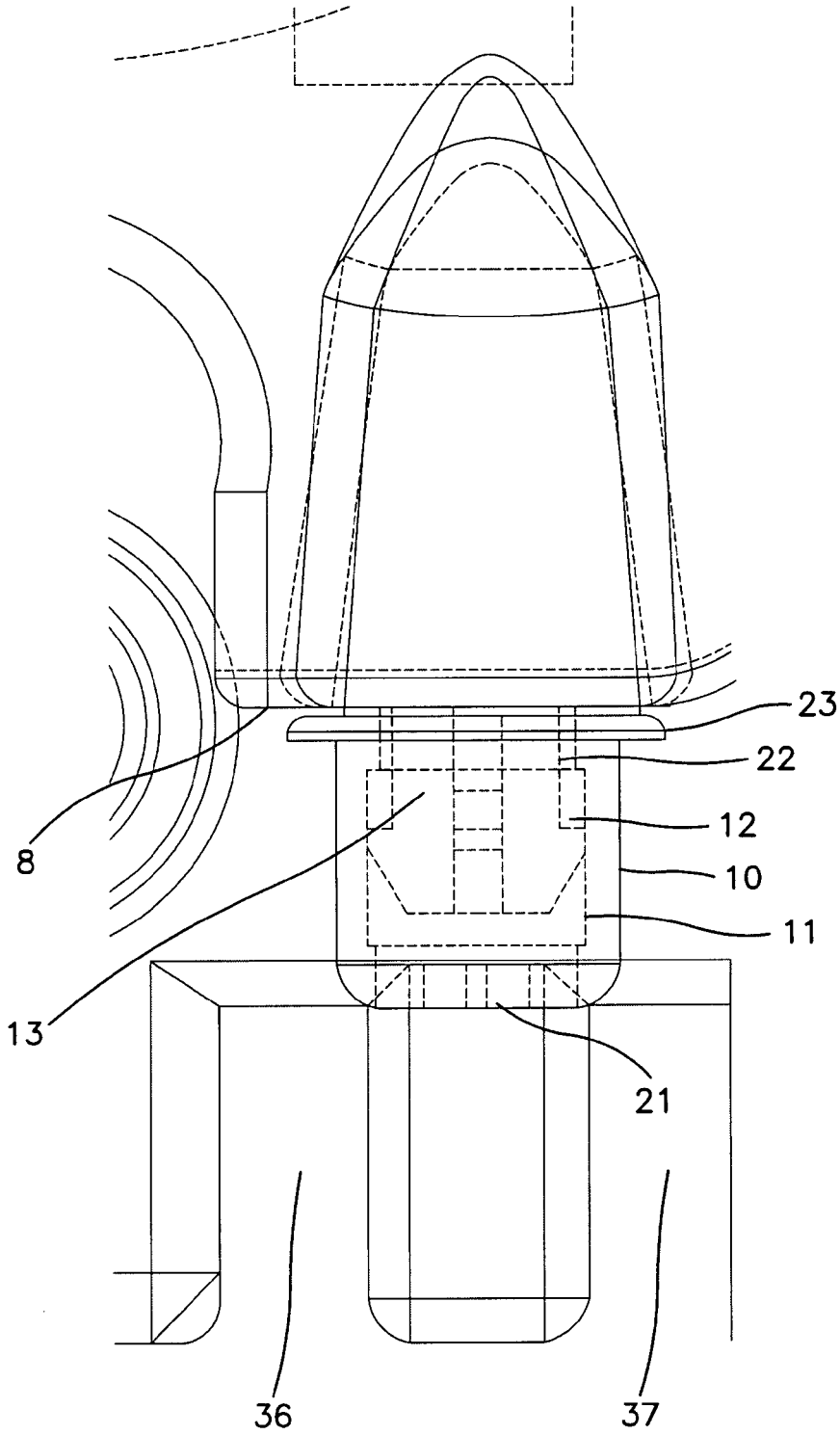
FIG. 4 shows an enlarged view of an attempt to insert a holder with a used filter located on the extractor tool.
Figure 4A:
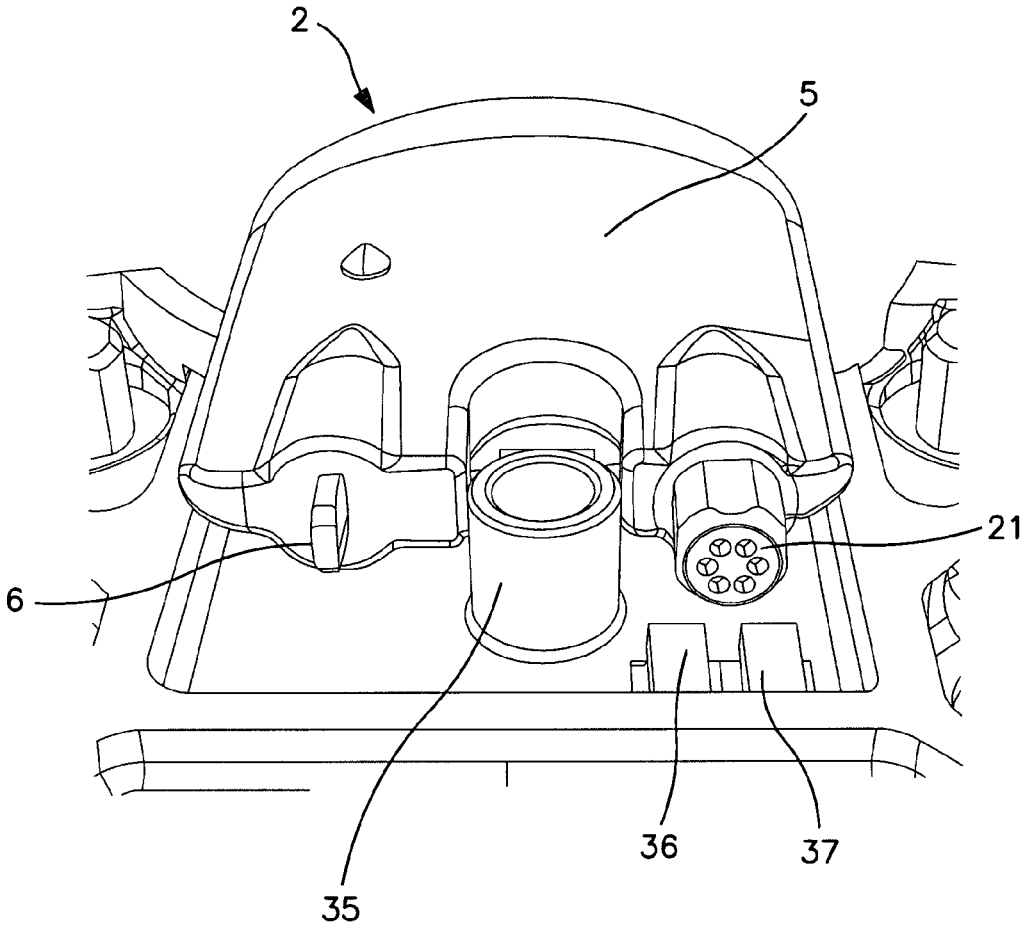
FIG. 4*a* is a perspective view showing the situation displayed in FIG. 4.

In FIGS. 3,4 and 4*a* material parts or shoulders 36, 37 are show, which narrowly surrounds the protruding part 13 of the second tool part 7 once the manipulator is placed in the pocket 3. In FIG. 4 it can be seen how the shoulders 36, 37 prevents insertion of the manipulator once a wax filter 10 is in position and held at the tool part 7. This effect is achieved also if the second tool 7 is shaped according to the second embodiment thereof as shown in FIGS. 5 and 6. These measures prevent the user from inadvertently re-inserting the manipulator in the holder once an old wax filter is fixed on the second tool part 7.

The above examples of the invention are made with reference to a wax filter, but the inventive concept can also advantageously be used in connection with other types of hearing aid filters like acoustic filters to be inserted into the sound canal from the receiver to the ear.

The invention claimed is:

1. Wax filter manipulator for extraction of a used wax filter and for insertion of a new filter in a hearing aid, whereby the manipulator comprises a gripping part to be gripped and held by a user and has a first tool part extending from the gripping part for initially holding a new filter and subsequently releasing the filter in the sound outlet tube or vent opening, wherein a second tool part is arranged adjacent to the first tool part and adapted to receive and hold a used filter in order to extract the filter from the vent or sound outlet opening of a hearing aid, and wherein the two tool parts are arranged side-by-side along one and the same edge part of the gripping part.

2. Filter manipulator as claimed in claim 1 where the second tool part comprise a protruding part extending from an edge portion of the gripping part, and where the protruding part has an outwardly extending flange portion at its outer end.

3. Filter manipulator as claimed in claim 2 where the outwardly extending flange portion has a surface facing the edge portion of the gripping part and where said surface extends essentially perpendicular to the length axis of the protruding part.

4. Filter manipulator as claimed in claim 2, where the protruding part in the direction of the length axis thereof is sectioned into two or more independent sections with slots of free space between the sections.

5. Filter manipulator as claimed in claim 1, where the second tool comprises blade parts having first and second opposed blade parts for gripping and holding a filter at the external circumference thereof.

6. Filter manipulator as claimed in claim 5, where the blade parts are arranged to extend along the surface of the edge portion of the gripping part but distanced from said edge portion.

7. Holder for a number of filter manipulators , whereby the manipulator comprises a gripping part to be gripped and held by a user and has a first tool part extending from the gripping part for initially holding a new wax filter and subsequently releasing the filter in a sound outlet tube or vent opening, wherein a second tool part is arranged adjacent to the first tool part and adapted to receive and hold a used wax filter in order to extract the filter from the vent or sound outlet opening of a hearing aid where the two tool parts are arranged side-by-side along one and the same edge part of the gripping part, whereby the holder has a number of open pockets each shaped to accommodate one manipulator such that the gripping part of the manipulator is accessible for gripping by the fingers of a user and such that the edge part of each manipulator with two tools extending therefrom is accommodated within the pocket.

8. Holder as claimed in claim 7, whereby each pocket has engagement means for releasable engagement with a filter manipulator.

9. Holder as claimed in claim 7, whereby the holder has a center part with the pockets arranged to extend radially away from said center part.

10. Holder as claimed in claim 9, whereby the pockets are arranged flat in one and the same plane.

11. System comprising a filter manipulator and a holder for a filter manipulator, whereby the manipulator has a first tool part for initially holding and subsequently releasing a new filter in the sound outlet tube, vent opening or sound passage of a hearing aid and a second tool part adapted to receive and hold a used filter where the manipulator further comprises a gripping part to be gripped and held by a person and where the first and second tool parts are arranged side-by-side along one and the same edge part of the gripping part, whereby the holder for the manipulator comprises at least one pocket for accommodating at least the two tool parts.

12. System as claimed in claim 11, whereby a snap lock mechanism is provided between the holder and the filter manipulator for releasable engagement between the two.

13. System as claimed in claim 12, whereby the snap lock mechanism comprises a U-shaped cut out in the manipulator with a first and a second leg, and a protruding part inside the pocket, whereby the legs of the U-shaped cut-out of the manipulator are shaped to embrace the protruding part in interlocking engagement when the manipulator is inserted into the pocket.

14. System as claimed in claim 13, whereby the U-shaped cut-out is arranged between the two tool parts of the manipulator , and such that the first and second leg of the U-shaped cut-out carry the first and second tool part respectively.

15. System as claimed in claim 11, where the filter manipulator and the pocket are shaped in asymmetric fashion, such that the manipulator can only be inserted in the pocket when oriented in one way with respect to the holder.

16. System as claimed in claim 11, where the pocket has material parts or shoulders which narrowly surrounds the second tool part of the manipulator when the manipulator is clicked in place in the pocket in order that the manipulator cannot be inserted into the pocket of the holder once a used filter is held at the second tool part.

17. System as claimed in claim 13, whereby the U-shaped cut-out is slightly off-set to one side to make one of the legs of the U-shaped cut out bigger than the other leg, and that the corresponding protruding part in the pocket is similarly off set to thereby assure the asymmetric shape of the manipulator and pocket.

* * * * *